US009719232B2

(12) United States Patent
Manchester

(10) Patent No.: US 9,719,232 B2
(45) Date of Patent: Aug. 1, 2017

(54) PUMP APPARATUS AND UNDERWATER TRENCHING APPARATUS

(71) Applicant: IHC ENGINEERING BUSINESS LIMITED, Sliedrecht (NL)

(72) Inventor: Jonathan Ralph Manchester, Rowlands Gill (GB)

(73) Assignee: IHC ENGINEERING BUSINESS LIMITED (GB)

( * ) Notice: Subject to any disclaimer, the term of this patent is extended or adjusted under 35 U.S.C. 154(b) by 160 days.

(21) Appl. No.: 14/366,114

(22) PCT Filed: Dec. 21, 2012

(86) PCT No.: PCT/GB2012/053226

§ 371 (c)(1),
(2) Date: Jun. 17, 2014

(87) PCT Pub. No.: WO2013/093492

PCT Pub. Date: Jun. 27, 2013

(65) Prior Publication Data

US 2014/0360058 A1 Dec. 11, 2014

(30) Foreign Application Priority Data

Dec. 22, 2011 (GB) ..... 1122117.3

(51) Int. Cl.

| | |
|---|---|
| ***E02F 5/10*** | (2006.01) |
| ***E02F 3/92*** | (2006.01) |
| ***F04B 23/14*** | (2006.01) |
| ***F04D 13/12*** | (2006.01) |
| ***F04F 5/54*** | (2006.01) |
| ***E02F 3/90*** | (2006.01) |

(Continued)

(52) U.S. Cl.

CPC ..... *E02F 5/107* (2013.01); *E02F 3/90* (2013.01); *E02F 3/9206* (2013.01); *E02F 9/226* (2013.01); *F04B 23/14* (2013.01); *F04D 13/12* (2013.01); *F04F 5/12* (2013.01); *F04F 5/48* (2013.01); *F04F 5/54* (2013.01)

(58) Field of Classification Search

CPC ..... E02F 5/107; E02F 3/9206; F04D 9/04; F04D 9/06; F04D 13/12; F04B 23/14

See application file for complete search history.

(56) References Cited

U.S. PATENT DOCUMENTS 1,152,326 A 8/1915 Lewis
2,056,994 A * 10/1936 Woods ..... F04F 5/464 417/79

(Continued)

FOREIGN PATENT DOCUMENTS

EP 0606909 A1 7/1994
EP 1167637 A2 1/2002

(Continued)

*Primary Examiner* — Matthew D Troutman

(74) *Attorney, Agent, or Firm* — Nexsen Pruet, PLLC; E. Eric Mills

(57) ABSTRACT

A pump apparatus comprises a primary pump having a relatively low pressure fluid input and a relatively high pressure fluid output and means, associated with said primary pump fluid input, operable where the ambient pressure is insufficient substantially to prevent cavitation in the primary pump, to locally increase the pressure at said primary pump fluid input.

6 Claims, 1 Drawing Sheet

(51) Int. Cl.

| | |
|---|---|
| ***E02F 9/22*** | (2006.01) |
| ***F04F 5/12*** | (2006.01) |
| ***F04F 5/48*** | (2006.01) |

(56) References Cited

U.S. PATENT DOCUMENTS

| | | | | | |
|---|---|---|---|---|---|
| 2,203,077 | A | | 6/1940 | Carpenter | |
| 2,524,770 | A | | 10/1950 | Marotzke | |
| 2,657,641 | A | | 11/1953 | Lung | |
| 2,693,085 | A | | 11/1954 | Salnikov | |
| 2,853,013 | A | | 9/1958 | Lung | |
| 3,527,384 | A | * | 9/1970 | Susugu | B63B 27/24 114/74 R |
| 3,646,694 | A | * | 3/1972 | Beck, Jr. | E02F 3/90 299/8 |
| 4,022,028 | A | * | 5/1977 | Martin | E02F 3/9206 37/330 |
| 4,112,695 | A | * | 9/1978 | Chang | E02F 3/8875 37/323 |
| 4,117,689 | A | * | 10/1978 | Martin | E02F 3/9206 239/596 |
| 4,165,571 | A | * | 8/1979 | Chang | E02F 5/104 37/322 |
| 4,294,573 | A | * | 10/1981 | Erickson | E21B 43/124 415/121.2 |
| 4,381,175 | A | | 4/1983 | Erickson | |
| 4,516,880 | A | * | 5/1985 | Martin | E02F 5/105 405/160 |
| 5,288,172 | A | * | 2/1994 | Reuhl | E02B 3/023 37/344 |
| 5,454,532 | A | * | 10/1995 | Whitmire | B64F 5/0054 244/134 B |
| 5,659,983 | A | * | 8/1997 | Coutarel | E02F 5/105 37/142.5 |
| 6,244,827 | B1 | * | 6/2001 | Popov | F04F 5/54 417/313 |
| 6,719,494 | B1 | * | 4/2004 | Machin | E02F 3/9206 37/344 |
| 6,904,856 | B2 | * | 6/2005 | Wallace | E02F 5/003 114/51 |
| 7,059,824 | B2 | * | 6/2006 | Ramacciotti | F04D 9/048 415/11 |
| 2002/0017041 | A1 | | 2/2002 | Gloppen et al. | |
| 2004/0013534 | A1 | | 1/2004 | Hutchinson et al. | |
| 2004/0175279 | A1 | * | 9/2004 | Ramacciotti | F04D 9/048 417/307 |
| 2005/0077057 | A1 | | 4/2005 | Laskaris | |
| 2010/0111718 | A1 | | 5/2010 | Schultz | |
| 2011/0223039 | A1 | * | 9/2011 | Fang | F04B 23/14 417/54 |

FOREIGN PATENT DOCUMENTS

| | | | |
|---|---|---|---|
| EP | 1245831 | A2 | 10/2002 |
| GB | 1570774 | A | 7/1980 |
| JP | 0179651 | U | 5/1989 |
| JP | 2004218493 | | 8/2004 |
| JP | 2005207322 | A | 8/2005 |
| WO | 02090667 | A1 | 11/2002 |

* cited by examiner

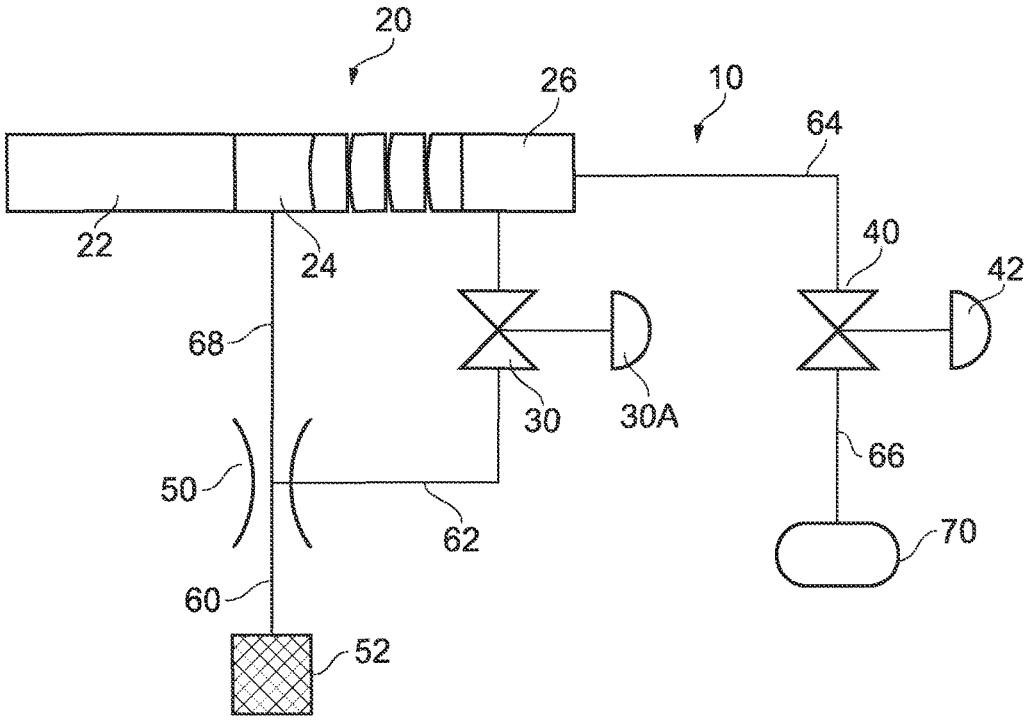
20
26
10
64
22
24
40
42
68
30
30A
66
50
62
70
60
52

PUMP APPARATUS AND UNDERWATER TRENCHING APPARATUS

This invention relates to a pump apparatus and in particular to a pump apparatus configured to produce an output of water at high pressure in shallow water. The pump apparatus of the invention is particularly applicable to apparatus which uses jetting tools to cut subsea trenches. Such trenches are necessary for burying pipes or cable in the seabed, for example.

BACKGROUND

Trench cutting apparatus using high pressure water jets to form the trench are well known in the subsea environment. Until recently the primary use of such trench cutting apparatus has been in relatively deep water. However, there is increasing demand to employ trench cutting apparatus in shallower water conditions. The use of jetting tools in shallow water presents some problems.

To supply water at high pressure to the outlet(s) of a jetting tool, a pump is used to pump water from the environment around the jetting tool. Generally the pump is submerged and in relatively close proximity to the high pressure outlets. For example, the pump may conveniently be mounted to the body of an underwater trench cutting vehicle. For applications of this sort, it is preferred to use high specific speed pumps such as multi-stage axial pumps and mixed axial flow pumps since the size and weight of pumps of this type are generally lower than lower specific speed pumps such as centrifugal type pumps.

The high intake flows of high specific speed pumps have the effect of lowering the ambient fluid pressure in the intake side of the pump. In deep water conditions this is acceptable, but in shallow water conditions the reduction in ambient pressure can be sufficient to cause cavitation in the pump. As is well known, cavitation is likely to reduce the performance and service life of the pump.

One proposed solution to the problem of cavitation in shallower water is to install an auxiliary pump upstream of the primary pump, the auxiliary pump providing low pressure and high flow. Such an auxiliary pump can be mounted on the trenching vehicle or on a service vessel or on the shore, for example. However, this is inconvenient and adds complexity to the overall apparatus. It is also possible to use low specific speed pumps as the primary pump, but as noted above such pumps carry a weight penalty and are more expensive.

The present invention seeks to obviate or mitigate such problems and to provide a pump apparatus, in particular for a jetting tool of a trench cutting apparatus, which is suitable for use in shallower water and which reduces or avoids problems of cavitation.

BRIEF SUMMARY OF THE DISCLOSURE

In accordance with a first aspect of the present invention there is provided a pump apparatus comprising a primary pump having a relatively low pressure fluid input and a relatively high pressure fluid output and means, associated with said primary pump fluid input, operable where the ambient pressure is insufficient substantially to prevent cavitation in the primary pump, to locally increase the pressure at said primary pump fluid input.

In preferred embodiments said means operable to locally increase the pressure at said fluid input is a jet pump.

Preferably the jet pump has an input and an output, the input being in fluid communication with the high pressure output of the primary pump and the output being in fluid communication with the input of the primary pump.

Preferably the pump apparatus further comprises an isolator operable to isolate the jet pump from the high pressure outlet of the primary pump.

Preferably the primary pump comprises one or more controllable flow restricting valves upstream of the high pressure fluid output, said valves having a flow restricting condition and a non-flow restricting condition, said flow restricting condition operatively reducing the input flow to the primary pump and increasing the exhaust pressure at the primary pump fluid output, as compared to the non-flow restricting condition.

According to a second aspect of the present invention there is provided an underwater trenching apparatus for operation in shallow water, the apparatus comprising a trench-cutting high pressure jetting tool and a primary pump having a relatively high pressure fluid output in fluid communication with said jetting tool and a relatively low pressure fluid input, and means, associated with said primary pump fluid input, operable where the ambient pressure is insufficient to prevent cavitation in the primary pump, to locally increase the pressure at said primary pump fluid input.

In preferred embodiments of this second aspect, said means operable to locally increase the pressure at said fluid input is a jet pump.

Preferably in this second aspect the jet pump has an input and an output, the input being in fluid communication with the high pressure output of the primary pump and the output being in fluid communication with the input of the primary pump.

Preferably the underwater trenching apparatus further comprises an isolator operable to isolate the jet pump from the high pressure outlet of the primary pump, said isolator being operable where the ambient pressure is sufficient substantially to prevent cavitation in the primary pump.

Preferably in this second aspect the primary pump comprises one or more controllable flow restricting valves upstream of the high pressure fluid output, said valves having a flow restricting condition and a non-flow restricting condition, said flow restricting condition operatively reducing the input flow to the primary pump and increasing the exhaust pressure at the primary pump fluid output, as compared to the non-flow restricting condition.

According to a third aspect of the present invention there is provided a method of operating an underwater trenching apparatus for operation in shallow water, the apparatus comprising a trench-cutting high pressure jetting tool and a primary pump having a relatively high pressure fluid output in fluid communication with said jetting tool and a relatively low pressure fluid input, the method comprising, where the ambient pressure is insufficient substantially to prevent cavitation in the primary pump, locally increasing the pressure at said primary pump fluid input.

Preferably the step of locally increasing the pressure at said fluid input comprises using a jet pump in fluid communication with said fluid input.

Preferably the jet pump has an input and an output, the input being in fluid communication with the high pressure output of the primary pump and the output being in fluid communication with the input of the primary pump.

In preferred embodiments the method further comprises isolating the jet pump from the high pressure outlet of the primary pump where the ambient pressure is sufficient substantially to prevent cavitation in the primary pump.

Preferably the primary pump comprises one or more controllable flow restricting valves upstream of the high pressure fluid output, said valves having a flow restricting condition and a non-flow restricting condition, said flow restricting condition operatively reducing the input flow to the primary pump and increasing the exhaust pressure at the primary pump fluid output, as compared to the non-flow restricting condition, the method comprising, on initially starting the primary pump where the ambient pressure is insufficient substantially to prevent cavitation, causing the one or more flow restricting valves to adopt the flow restricting condition, and, when the pressure at the fluid input of the primary pump reaches a predetermined threshold value, causing the one or more flow restricting valves to adopt the non-flow restricting condition.

BRIEF DESCRIPTION OF THE DRAWINGS

Embodiments of the invention are further described hereinafter by way of example only with reference to the accompanying drawing, in which:

FIG. 1 is a schematic illustration of a pump apparatus according to the present invention.

DETAILED DESCRIPTION

Referring now to the drawing the pump apparatus 10 according to the invention comprises a primary pump 20 and a jet pump 50. The primary pump 20 is a high specific speed pump such as a multi stage axial pump or a mixed axial flow pump.

In the illustrated embodiment, the primary pump 20 can be seen to comprise a primary pump motor 22, a primary pump intake 24 and an exhaust manifold or output 26. The primary pump outlet 26 communicates via lines 64 and 66 with a jetting tool 70. Specifically, the primary pump 20 supplies water at high pressure to the jetting tool 70 via lines 64, 66, the water being expelled from one or more nozzles of the jetting tool 70, for cutting a trench in the seabed.

Jet pumps per se are known in the art and the construction of suitable jet pumps will be known to persons skilled in the art. The jet pump 50 in FIG. 1 has a main water inlet via line 60 from an intake 52. The intake 52 can usefully include a strainer or the like to prevent the take up of any debris which may be in the water. The output of the jet pump 50 is via a line 68 to the input 24 of the primary pump 20. The motive fluid input of the jet pump 50 is via line 62 which is in fluid communication with the high pressure output 26 of the primary pump 20.

An isolator valve 30 is included in line 62, by means of which the jet pump 50 can be isolated from the output 26 of the primary pump. That is, in the isolating condition of the isolating valve 30 the flow of motive fluid from the output 26 of the primary pump to the jet pump 50 is stopped.

Line 64 from the output 26 of the primary pump terminates in fluid communication with one or more throttling valves (flow restricting valves) 40. From the throttling valve or valves 40, line 66 communicates with the jetting tool 70. Thus the jetting tool 70 receives high pressure water from the output 26 of the primary pump 20.

The one or more throttling valves 40 are controllable, such as by means of an actuator 42, selectively to adopt a throttling (flow-restricting) condition or a non-throttling (non-flow-restricting) condition.

In operation the primary pump 20 is submerged. For example the primary pump 20 may be mounted on a main body of a trenching apparatus. In conventional deep water operation where there is little or no danger of cavitation in the primary pump 20, the isolating valve 30 may be closed, so that the jet pump 50 is not in communication with the output 26 of the primary pump 20. In this condition, the input 24 of the primary pump 20 receives fluid (i.e. water in which the primary pump 20 is submerged) at the ambient pressure of the surrounding water. It is noted that even when the jet pump 50 is not operational (because isolator valve 30 is closed) the jet pump still allows flow of water to the primary pump input 24. In deep water operation, the pressure of the water in the immediate vicinity of the pump 20 is sufficiently high to avoid cavitation in the pump. Isolation of the jet pump 50 from the output 26 of the primary pump 50 in deep water conditions is advantageous in increasing the efficiency of the pump apparatus in such conditions.

However, in shallow water conditions, the ambient pressure of the water in the immediate vicinity of the primary pump 20 may not be sufficient to prevent cavitation in the pump.

The pump apparatus 10 of the invention is operated in shallow water conditions with the isolating valve 30 open. Thus the jet pump 50 communicates via line 62 with the high pressure output 26 of the primary pump 20. That is, a portion of the output flow of output 26 is diverted via line 62 to the jet pump 50. The high pressure water flow received via line 62 by jet pump 50 forms the motive fluid for the jet pump 50. Thus, in this operational state, the local pressure of water received at the input 24 of the primary pump 20 is increased to the extent that the possibility of cavitation in the pump is reduced or eliminated.

The isolating valve 30 may be manually operated, or may be operated by an actuator 30A. Where the pump apparatus 10 operates exclusively in shallow water environments, isolator valve 30 is not necessary.

In operational conditions, the pump apparatus 10 of the invention may move from shallow water conditions to deep water conditions, or vice versa, while in an operational state. In moving from shallow water conditions to deep water conditions, the valve 30 can be closed when the water in the vicinity of the primary pump 20 is sufficiently deep for there to be a sufficiently low risk of cavitation in the pump 20.

Conversely in moving from deep water conditions to shallow water conditions the valve 30 can be opened when the water in the vicinity of the primary pump 20 is still sufficiently deep for there to be a sufficiently low risk of cavitation in the pump 20, that is, before the water becomes so shallow that there is an appreciable risk of cavitation.

In the case either of a transition from deep water to shallow water or from shallow water to deep water it is not necessary interrupt the operation of the primary pump 20.

When the pump apparatus 10 according to the invention is started (from rest) in deep water conditions, the isolating valve 30 can be set to the closed position before operation of the primary pump commences.

When the pump apparatus 10 according to the invention is started (from rest) in shallow water conditions, steps must be taken to prevent cavitation in the initial stages of operation, that is, before the jet pump 50 is effective in raising the input pressure to the primary pump input 24. To this end, the output 26 of the primary pump 20 communicates via line 64 with one or more throttling valves 40 which can selectively adopt throttling and non-throttling conditions. For starting of the pump apparatus 10 in shallow water conditions, the one or more valves 40 are set to a throttling condition, for example by means of actuator 42. Setting valve or valves 40 in the throttling condition has the effect of reducing the inlet flow to the primary pump 20 and increasing the exhaust pressure at the primary pump output 26. The possibility of cavitation is thus avoided or at least significantly reduced. The jet pump 50 receives high pressure input via line 62 (since the isolator valve 30 is open) and thus increases the pressure at the primary pump input 24, again reducing the possibility of cavitation. The throttling valve or valves 40 can then be opened and the pump apparatus 10 is in its fully operational state.

In some embodiments the pump apparatus 10 according to the invention includes a plurality of valves 40. In such embodiments, the plurality of valves 40 may each independently be in communication with a plurality of nozzles on the jetting tool 70. Each valve 40 may independently adopt a throttling and non-throttling condition as outlined above. Advantageously the use of a plurality of nozzles on the jetting tool 70 in combination with a plurality of valves 40 minimizes any reduction in pressure in the fluid expelled from the jetting tool 70. Each nozzle on the jetting tool 70 may thus receive fluid from a separate valve 40 ensuring that any reduction in pressure occurs across the nozzle of the jetting tool 70 and not the valve 40. The efficiency of the pump apparatus 10 in such embodiments can be optimised by each valve 40 adopting a fully open or fully closed position.

In some embodiments components of the pump apparatus 10 according to the invention can be operated at different speeds to further reduce the risk of cavitation. The primary pump 20 may therefore incorporate a variable speed drive system. Thus when the pump apparatus 10 according to the invention is started (from rest) in shallow water conditions, the primary pump 20 may be set to a reduced speed in order to reduce the risk of cavitation in the initial stages of operation.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments.

The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A pump apparatus comprising a primary pump having a relatively low pressure fluid input and a relatively high pressure fluid output, a jet pump, associated with said primary pump fluid input, operable to prevent cavitation in the primary pump by increasing locally the pressure at said primary pump fluid input, wherein the jet pump has an input and an output, the jet pump input being in fluid communication with the high pressure fluid output of the primary pump and the jet pump output being in fluid communication with the low pressure fluid input of the primary pump, and an isolator operable to isolate the jet pump from the high pressure fluid output of the primary pump, wherein the primary pump comprises one or more controllable flow restricting valves in fluid communication via a line with the high pressure fluid output, said valves having a flow restricting condition and a non-flow restricting condition, said flow restricting condition operatively reducing the input flow to the primary pump and increasing the exhaust pressure at the primary pump fluid output, as compared to the non-flow restricting condition, wherein when the one or more flow restricting valves are in the flow restricting condition and the isolator is in an open position, the jet pump receives high pressure fluid via the jet pump input.

2. An underwater trenching apparatus, the apparatus comprising a trench-cutting jetting tool, a primary pump having a relatively high pressure fluid output in fluid communication with said jetting tool and a relatively low pressure fluid input, a jet pump, associated with said primary pump fluid input, operable to prevent cavitation in the primary pump by increasing locally the pressure at said primary pump fluid input, wherein the jet pump has an input and an output, the jet pump input being in fluid communication with the high pressure fluid output of the primary pump and the jet pump output being in fluid communication with the low pressure fluid input of the primary pump, and an isolator operable to isolate the jet pump from the high pressure output of the primary pump, said isolator being operable where the ambient pressure is sufficient substantially to prevent cavitation in the primary pump, wherein the primary pump comprises one or more controllable flow restricting valves in fluid communication via a line with the high pressure fluid output, wherein said valves having a flow restricting condition and a non-flow restricting condition, said flow restricting condition operatively reducing the input flow to the primary pump and increasing the exhaust pressure at the primary pump fluid output, as compared to the non-flow restricting condition, wherein when the one or more flow restricting valves are in the flow restricting condition and the isolator is in an open position, the jet pump receives high pressure fluid via the jet pump input.

3. A method of operating an underwater trenching apparatus, the apparatus comprising a trench-cutting jetting tool and a primary pump having a relatively high pressure fluid output in fluid communication with said jetting tool and a relatively low pressure fluid input, wherein the primary pump comprises one or more controllable flow restricting valves in fluid communication via a line with the high pressure fluid output, wherein said valves having a flow restricting condition and a non-flow restricting condition, said flow restricting condition operatively reducing the input flow to the primary pump and increasing the exhaust pressure at the primary pump fluid output, as compared to the non-flow restricting condition, the method comprising locally increasing the pressure at said primary pump fluid input, the method further comprising on initially starting the primary pump, causing the one or more flow restricting valves to adopt the flow restricting condition, and, when the pressure at the fluid input of the primary pump reaches a predetermined threshold value, causing the one or more flow restricting valves to adopt the non-flow restricting condition.

4. A method as claimed in claim 3 wherein the step of locally increasing the pressure at said primary pump fluid input comprises using a jet pump in fluid communication with said fluid input.

5. A method as claimed in claim 4 wherein the jet pump has an input and an output, the input being in fluid communication with the high pressure output of the primary pump and the output being in fluid communication with the input of the primary pump.

6. A method as claimed in claim 5 further comprising isolating the jet pump from the high pressure outlet of the primary pump where the ambient pressure is sufficient to prevent cavitation in the primary pump.

* * * * *